US007527124B2

(12) United States Patent
Tokura et al.

(10) Patent No.: US 7,527,124 B2
(45) Date of Patent: May 5, 2009

(54) LOUDSPEAKER DIAPHRAGM

(75) Inventors: Kunihiko Tokura, Tokyo (JP); Toru Takebe, Tokyo (JP); Masaru Uryu, Chiba (JP); Takahisa Tagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 249 days.

(21) Appl. No.: 11/500,309

(22) Filed: Aug. 8, 2006

(65) Prior Publication Data

US 2007/0034443 A1 Feb. 15, 2007

(30) Foreign Application Priority Data

Aug. 10, 2005 (JP) ..... 2005-232208

(51) Int. Cl.
*H04R 7/02* (2006.01)
*G10K 13/00* (2006.01)
*H04R 7/10* (2006.01)

(52) U.S. Cl. ..... 181/169; 381/428

(58) Field of Classification Search ..... 181/169, 181/167; 381/426, 428, 423; 162/156, 218, 162/157.3, 138, 164.6
See application file for complete search history.

(56) References Cited

U.S. PATENT DOCUMENTS

| | | | | |
|---|---|---|---|---|
| 5,102,729 | A * | 4/1992 | Yamaguchi et al. | 442/147 |
| 5,149,486 | A * | 9/1992 | Baba | 264/553 |
| 6,390,232 | B1 * | 5/2002 | Kirschbaum | 181/169 |
| 7,092,544 | B2 * | 8/2006 | Hachiya et al. | 381/426 |
| 2003/0223613 | A1 * | 12/2003 | Hachiya | 381/423 |
| 2004/0112672 | A1 * | 6/2004 | Ono et al. | 181/169 |
| 2005/0257998 | A1 * | 11/2005 | Sato et al. | 181/167 |
| 2007/0017736 | A1 * | 1/2007 | Takebe et al. | 181/167 |
| 2008/0087493 | A1 * | 4/2008 | Ikeda et al. | 181/167 |

FOREIGN PATENT DOCUMENTS

| | | | |
|---|---|---|---|
| JP | 02214294 A | * | 8/1990 |
| JP | 2670365 | | 7/1997 |

* cited by examiner

*Primary Examiner*—Edgardo San Martin
(74) *Attorney, Agent, or Firm*—Oblon, Spivak, McClelland, Maier & Neustadt, P.C.

(57) ABSTRACT

Wholly aromatic polyamide fibers cut to a length of 0.5 to 5 mm are dispersedly contained in an injection-moldable thermoplastic resin, and the resin is molded by ultrahigh-speed thin-wall injection molding so as to produce a loudspeaker diaphragm in which the wholly aromatic polyamide fibers are dispersed in a direction perpendicular to the resin flow direction, whereby the loudspeaker diaphragm is improved in internal loss.

13 Claims, 5 Drawing Sheets

SECTION IN RESIN FLOW DIRECTION

SECTION IN DIRECTION ORTHOGONAL TO RESIN FLOW DIRECTION

LOUDSPEAKER DIAPHRAGM

CROSS REFERENCES TO RELATED APPLICATIONS

The embodiment of the present invention contains subject matter related to Japanese Patent Application JP 2005-232208 filed with the Japanese Patent Office on Aug. 10, 2005, the entire contents of which being incorporated herein by reference.

BACKGROUND OF THE INVENTION

1. Field of the Invention

The present invention relates to a loudspeaker diaphragm.

2. Description of the Related Art

In general, it is desirable for a loudspeaker diaphragm to have a high specific modulus E/ρ (E is modulus of elasticity; ρ is density) for broadening the piston motion region and to have a high internal loss for smoothing the frequency characteristic.

Hitherto, for enhancing the modulus of elasticity E, materials obtained by loading a polypropylene material having a comparatively high internal loss with high-elasticity fibers or filler have been frequently used in injection molding and sheet molding.

However, since the specific gravity of the molding material increases with an increase in the addition amount of the fibers or filler, enhancement of the specific modulus is restrained. In addition, injection molding is accompanied by a lowering in resin flow length, making it difficult to achieve thin-wall molding. Thus, there has been a limit to enhancement of both the specific modulus and the internal loss.

In view of the above, the present applicant, in Japanese Patent No. 2670365, has proposed a loudspeaker diaphragm produced by a method in which a thermoplastic resin composed mainly of a polyolefin composition produced by multistage polymerization and containing an ultrahigh molecular weight polyolefin having a limiting viscosity of 10 to 40 dl/g as measured in a decalin solution at 135° C. and a low molecular weight or high molecular weight polyolefin having a limiting viscosity of 0.1 to 5 dl/g as measured in a decalin solution at 135° C. is injection molded, and the ultrahigh molecular weight polyolefin is oriented radially.

This loudspeaker diaphragm has successfully realized a lower weight and a higher modulus of elasticity, as compared with the case of using the above-mentioned polypropylene composite material.

SUMMARY OF THE INVENTION

However, the loudspeaker diaphragm disclosed in Japanese Patent No. 2670365 is limited in application to the manufacture of a full-range unit or loudspeaker system, since the internal loss is reduced with an increase in the degree of orientation.

In consideration of this point, it is desirable to enhance the internal loss of a loudspeaker diaphragm in an embodiment of the present invention.

According to an embodiment of the present invention, there is provided a loudspeaker diaphragm wherein wholly aromatic polyamide fibers cut to a length of 0.5 to 5 mm are dispersedly contained in an injection moldable thermoplastic resin, and the resin is molded by superhigh-speed thin-wall injection molding, whereby the wholly aromatic polyamide fibers are dispersed in a direction perpendicular to the resin flow direction.

According to an embodiment of the present invention, the wholly aromatic polyamide fibers contained in the resin are dispersed in a direction perpendicular to the resin flow direction, whereby the internal loss is improved.

DETAILED DESCRIPTION OF THE PREFERRED EMBODIMENTS

Figure 1:
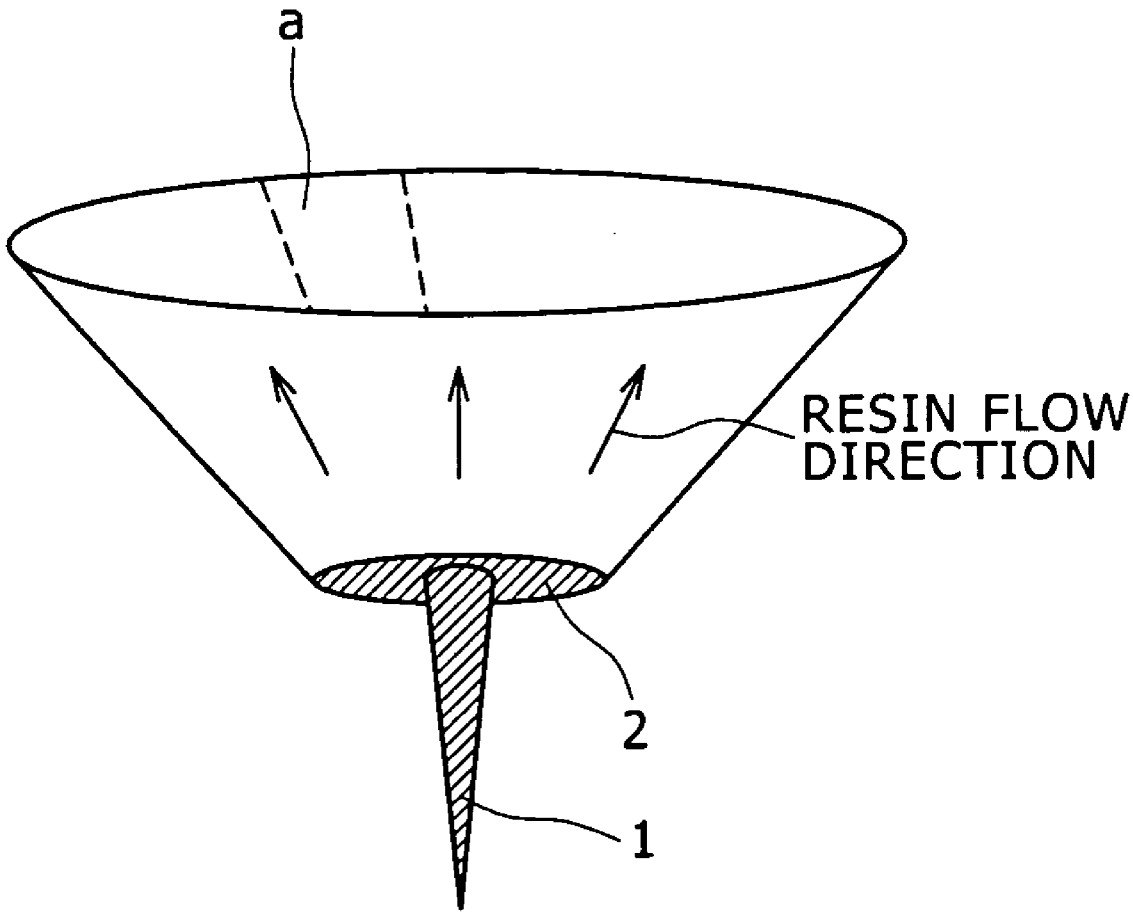
FIG. 1 is a perspective view of an embodiment of a loudspeaker diaphragm according to the present invention.

Now, an embodiment of the loudspeaker diaphragm according to the present invention will be described below referring to the drawings.

In this embodiment, wholly aromatic polyamide fibers cut to a length of 0.5 to 5 mm are dispersedly contained in a thermoplastic resin composed mainly of a polyolefin resin which contains an ultrahigh molecular weight polyolefin having a limiting viscosity of 10 to 40 dl/g as measured in a decalin solution at 135° C. and a low molecular weight to high molecular weight polyolefin having a limiting viscosity of 0.1 to 5 dl/g as measured in a decalin solution at 135° C. and which is prepared by a multistage polymerization method.

To be more specific, as the thermoplastic resin composed mainly of the polyolefin composition, there is used a thermoplastic resin which is prepared by a two-stage polymerization method of polymerizing ethylene in two stages in the presence of a catalyst composed mainly of a highly active solid titanium catalyst component and an organic aluminum compound catalyst component and which contains 25% by weight of an ultrahigh molecular weight polyolefin having a limiting viscosity of 30 dl/g as measured in a decalin solution at 135° C. and 75% by weight of a low molecular weight to high molecular weight polyolefin having a limiting viscosity of 0.7 dl/g as measured in a decalin solution at 135° C.

In addition, as the wholly aromatic polyamide fibers, Kevlar 49 (trade name) produced by du Pont (hereinafter referred to as Kevlar fibers) was used. It is to be noted that the wholly aromatic polyamide fibers are not limited to Kevlar fibers. The wholly aromatic polyamide fibers were coated with a urethane-based binding agent in an amount of 1 to 5% by weight based on the Kevlar fibers, followed by drying.

After the drying, the Kevlar fibers were cut to a length of 3 mm. The length of the fibers cut may be in the range of 0.5 to 5 mm. If the cut fibers are longer than 5 mm, it is difficult for the cut fibers to be appropriately dispersed when mixed with the thermoplastic resin composed mainly of the polyolefin composition.

Besides, the treatment with the binding agent is important not only for cutting the fibers but also for enhancing the compatibility with the thermoplastic resin. As the treating agent, a urethane-based one is most suitably used, but a dispersant such as olefin may also be used taking into account the compatibility with the thermoplastic resin.

In injection molding, by using a twin-screw extruder, the above-mentioned cut Kevlar fibers were appropriately mixed into the thermoplastic resin composed mainly of the polyolefin composition of the above embodiment at a temperature in the range of 240 to 290° C., and the mixture was pelletized.

In this case, the Kevlar fibers were mixed into the thermoplastic resin composed mainly of the polyolefin composition in a ratio of 15% by weight in Example 1, in a ratio of 20% by weight in Example 2, and in a ratio of 25% by weight in Example 3, before the pelletizing. Besides, as Comparative Example, the thermoplastic resin composed mainly of the polyolefin not admixed with the Kevlar fibers was pelletized.

By use of the pellets of Examples 1, 2 and 3 and Comparative Example, loudspeaker diaphragms were produced by ultrahigh speed injection molding, using an injection molding machine having the following principal specifications.

| | |
|---|---|
| Maximum injection pressure | 2800 Kg/cm$^2$ |
| Maximum injection speed | 1500 mm/sec |
| Rise-up speed | 10 msec |
| Clamping force | 160 t |
| Screw diameter | ϕ 32 mm |

As for the shape of the loudspeaker diaphragm in this embodiment, a shape was adopted in which the diaphragm is uniformly spread from a cold gate 1 at a central portion to a thin-walled diaphragm portion via a film gate 2. The thickness of the diaphragm was 350 μm.

The injection molding was conducted under the following conditions:

| | |
|---|---|
| Injection molding temperature | 240° C. |
| Injection speed | 1000 mm/sec |
| Mold temperature | 45° C. |

and samples were obtained upon confirmation of that the resin was fed to a predetermined outer peripheral portion.

For the samples thus prepared, the frequency characteristics of internal loss and Young's modulus of the loudspeaker diaphragms in the resin flow direction were measured by the vibrating reed method. The results are shown in Table 1 below.

TABLE 1

| Frequency | Internal loss | Young's modulus(Pa) |
|---|---|---|
| | Example 1 | |
| 200 Hz | $1.66 \times 10^{-2}$ | $6.60 \times 10^{9}$ |
| 1000 Hz | $1.58 \times 10^{-2}$ | $6.57 \times 10^{9}$ |
| 3000 Hz | $1.58 \times 10^{-2}$ | $6.56 \times 10^{9}$ |
| 5000 Hz | $1.58 \times 10^{-2}$ | $6.56 \times 10^{9}$ |
| 10000 Hz | $1.60 \times 10^{-2}$ | $6.53 \times 10^{9}$ |
| | Example 2 | |
| 200 Hz | $1.67 \times 10^{-2}$ | $7.62 \times 10^{9}$ |
| 1000 Hz | $1.67 \times 10^{-2}$ | $7.34 \times 10^{9}$ |
| 3000 Hz | $1.59 \times 10^{-2}$ | $7.29 \times 10^{9}$ |
| 5000 Hz | $1.60 \times 10^{-2}$ | $7.24 \times 10^{9}$ |
| 10000 Hz | $1.67 \times 10^{-2}$ | $7.17 \times 10^{9}$ |
| | Example 3 | |
| 200 Hz | $1.65 \times 10^{-2}$ | $7.46 \times 10^{9}$ |
| 1000 Hz | $1.64 \times 10^{-2}$ | $7.23 \times 10^{9}$ |
| 3000 Hz | $1.60 \times 10^{-2}$ | $7.16 \times 10^{9}$ |
| 5000 Hz | $1.61 \times 10^{-2}$ | $7.13 \times 10^{9}$ |
| 10000 Hz | $1.65 \times 10^{-2}$ | $7.09 \times 10^{9}$ |
| | Comparative Example | |
| 200 Hz | $1.39 \times 10^{-2}$ | $7.91 \times 10^{9}$ |
| 1000 Hz | $1.33 \times 10^{-2}$ | $7.50 \times 10^{9}$ |
| 3000 Hz | $1.35 \times 10^{-2}$ | $7.38 \times 10^{9}$ |
| 5000 Hz | $1.48 \times 10^{-2}$ | $7.22 \times 10^{9}$ |
| 10000 Hz | $1.47 \times 10^{-2}$ | $7.43 \times 10^{9}$ |

Figure 2:
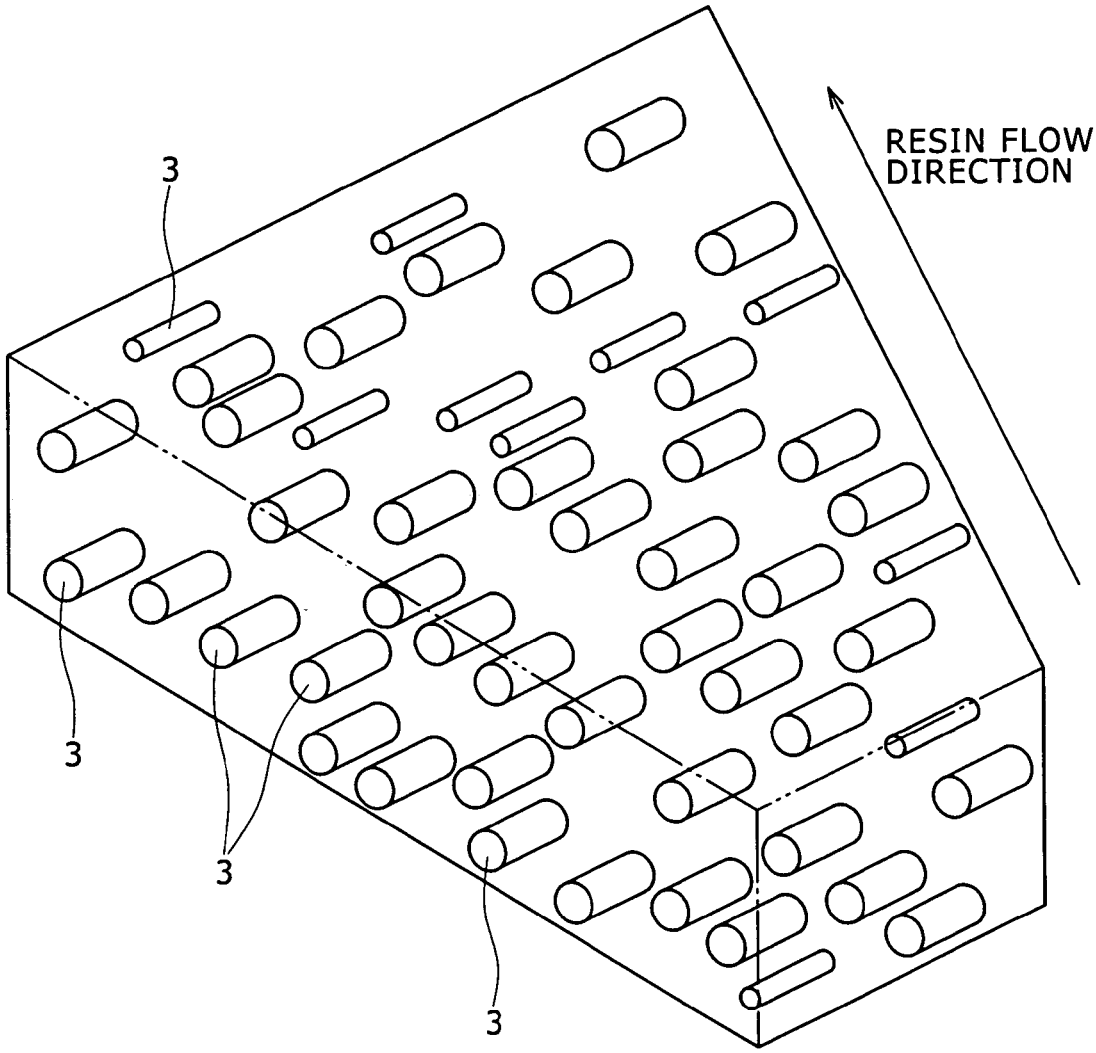
FIG. 2 is an enlarged schematic view of part a of FIG. 1.
Figure 3A:
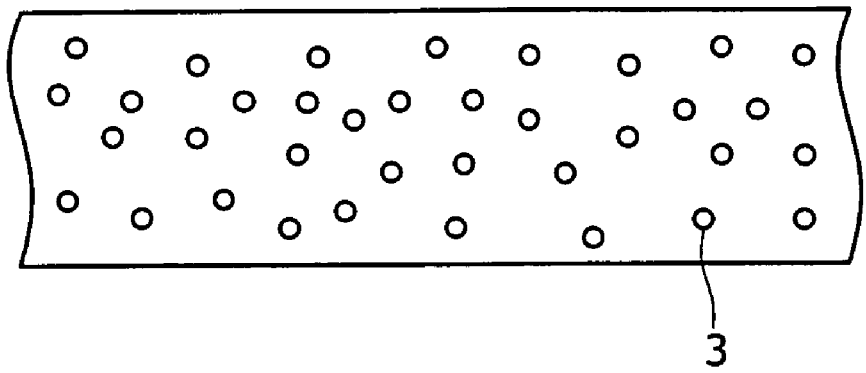
FIGS. 3A and 3B are partial enlarged sectional view of the embodiment of the loudspeaker diaphragm according to the present invention.
Figure 3B:
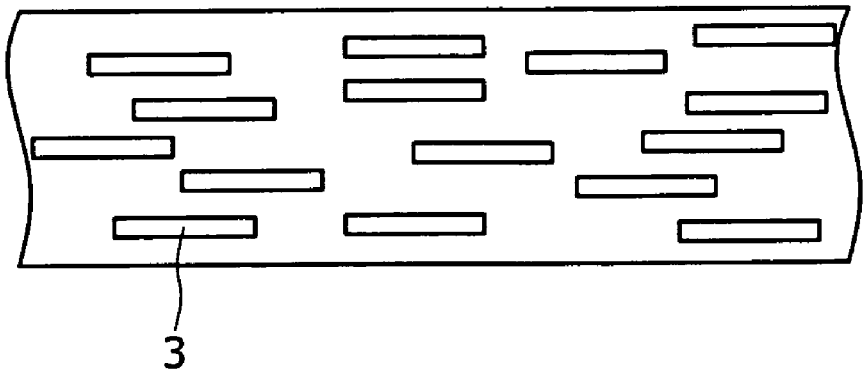

It is seen from the results given in Table 1 that in Examples 1, 2 and 3, the modulus of elasticity is little lowered and the internal loss is lowered, as compared with Comparative Example. The sections in the resin flow direction of the loudspeaker diaphragms produced in Examples 1, 2 and 3 were as shown in FIG. 2, which is an enlarged schematic view of part a of FIG. 1. It is seen from FIG. 2 that the Kevlar fibers 3 are dispersed in a direction perpendicular to the resin flow direction. To be more specific, the sectional view in the resin flow direction of the loudspeaker diaphragms obtained in Examples 1, 2 and 3 is as shown in FIG. 3A, and the sectional view in the direction orthogonal to the resin flow direction is as shown in FIG. 3B.

This shows that in this embodiment, the polyolefin composition prepared by polymerizing an ultrahigh molecular weight polyolefin having a high melt viscosity and a low molecular weight to high molecular weight polyolefin having a low melt viscosity by a two-stage polymerization method is used, and the molecular chains of the ultrahigh molecular weight polyolefin are radially oriented upon injection molding by utilizing the difference in fluidity between the two components, whereby the modulus of elasticity is enhanced. Besides, in this embodiment, the Kevlar fibers are aligned (dispersed) along the circumferential direction of the diaphragm (the direction perpendicular to the resin flow direction), whereby the internal loss is increased.

Figure 4:
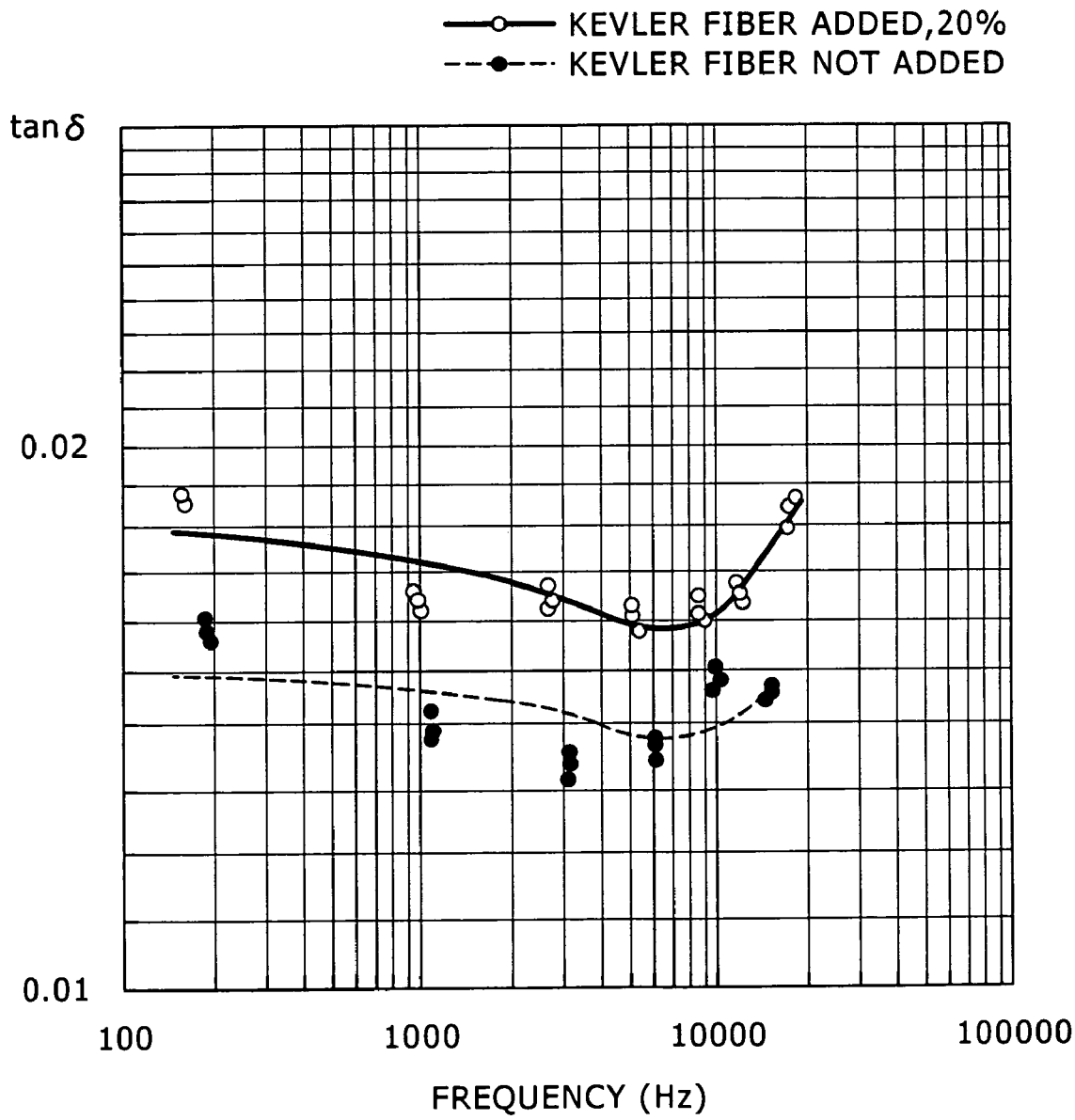
FIG. 4 is a diagram served to description of the present invention.

Incidentally, the variation in internal loss with frequency in Example 2 is as indicated by the solid line in FIG. 4. The internal loss in Example 2 is greater than the internal loss in Comparative Example, which is indicated by the broken line in FIG. 4.

Figure 5:
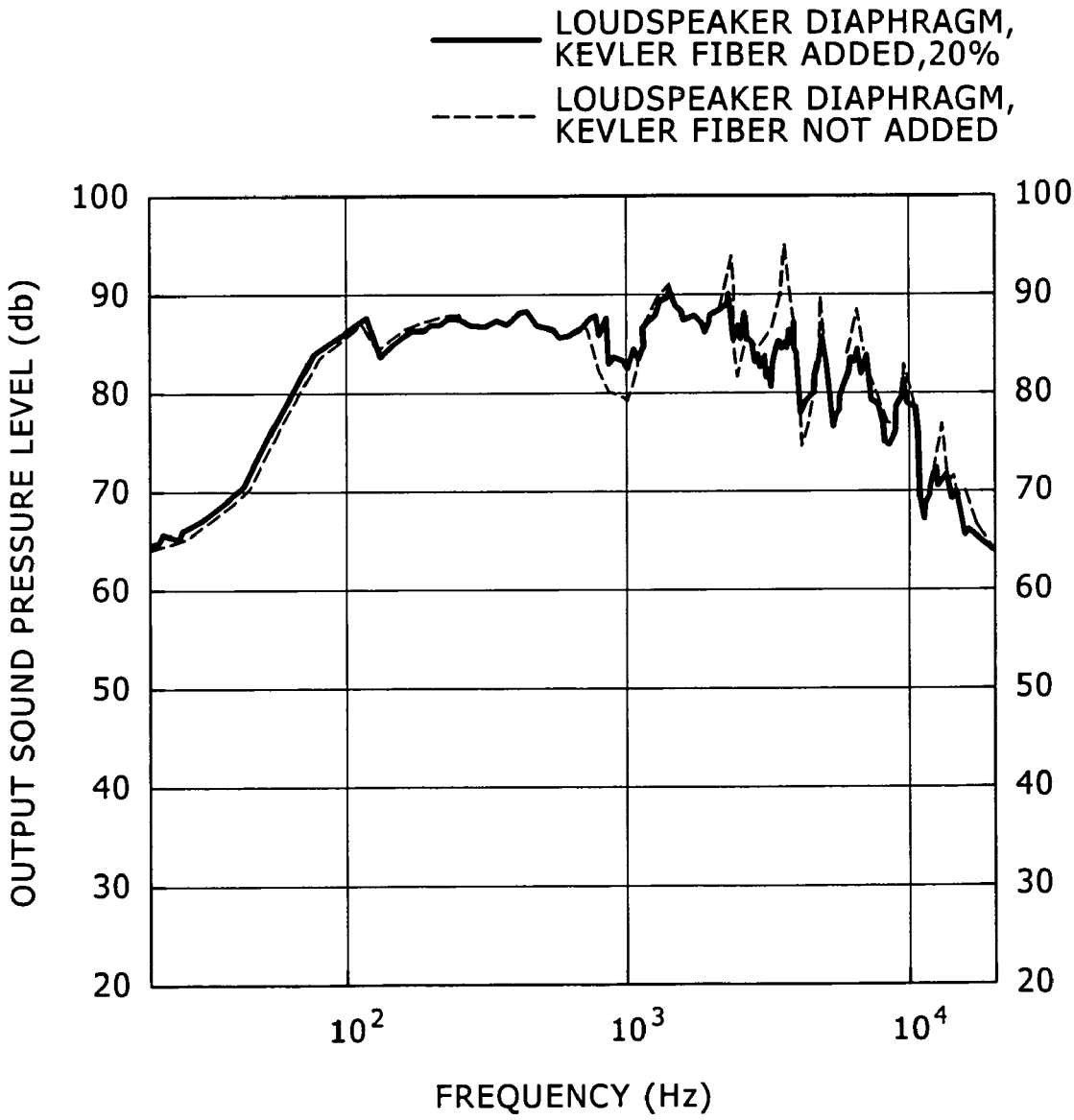
FIG. 5 is a diagram served to description of the present invention.

In addition, the frequency characteristic of a loudspeaker using the loudspeaker diaphragm produced in Example 2 is as indicated by the solid line in FIG. 5, and is smoother as compared with the frequency characteristic of a loudspeaker using the loudspeaker diaphragm produced in Comparative Example (the broken line in FIG. 5).

It should be understood by those skilled in the art that various modifications, combinations, sub-combinations and alterations may occur depending on design requirements and other factors insofar as they are within the scope of the appended claims or the equivalents thereof.

What is claimed is:

1. A loudspeaker diaphragm, comprising:

an inner surface and an outer surface, wherein wholly aromatic polyamide fibers cut to a length of 0.5 to 5 mm are dispersedly contained in an injection moldable thermoplastic resin positioned between the inner surface and the outer surface such that each of the wholly aromatic dispersed fibers are oriented in a direction perpendicular to a resin flow direction.

2. The loudspeaker diaphragm as set forth in claim 1, produced by superhigh-speed thin-wall injection molding.

3. The loudspeaker diaphragm as set forth in claim 1, wherein said thermoplastic resin is composed mainly of a polyolefin composition which contains an ultrahigh molecular weight polyolefin having a limiting viscosity of 10 to 40 dl/g as measured in a decalin solution at 135° C. and a low molecular weight to high molecular weight polyolefin having a limiting viscosity of 0.1 to 5 dl/g as measured in a decalin solution at 135° C. and which is prepared by a multistage polymerization method.

4. The loudspeaker diaphragm as set forth in claim 2, wherein the thermoplastic resin is composed mainly of a polyolefin composition which contains an ultrahigh molecular weight polyolefin having a limiting viscosity of 10 to 40 dl/g as measured in a decalin solution at 135° C. and a low molecular weight to high molecular weight polyolefin having a limiting viscosity of 0.1 to 5 dl/g as measured in a decalin solution at 135° C. and which is prepared by a multistage polymerization method.

5. The loudspeaker diaphragm as set forth in claim 1, wherein the wholly aromatic polyamide fibers are Kevlar.

6. The loudspeaker diaphragm as set forth in claim 5, wherein the wholly aromatic polyamide fibers are coated with a urethane-based binding agent in an amount of 1 to 5% by weight based on the Kevlar.

7. The loudspeaker diaphragm as set forth in claim 1, wherein the resin flow direction is from an inner edge of the loudspeaker diaphragm to an outer edge of the diaphragm.

8. A method of producing a loudspeaker diaphragm, comprising:

mixing wholly aromatic polyamide fibers into an injection moldable thermoplastic resin to form a mixture;

pelletizing the mixture; and forming the loudspeaker diaphragm from the pelletized mixture such that each of the wholly aromatic dispersed fibers are oriented in a direction perpendicular to a radial direction of the loudspeaker diaphragm.

9. The method of producing a loudspeaker diaphragm as set forth in claim 8, wherein the forming the loudspeaker diaphragm includes superhigh-speed thin-wall injection molding.

10. The method of producing a loudspeaker diaphragm as set forth in claim 8, wherein the thermoplastic resin comprises a polyolefin composition which contains an ultrahigh molecular weight polyolefin having a limiting viscosity of 10 to 40 dl/g as measured in a decalin solution at 135° C. and a low molecular weight to high molecular weight polyolefin having a limiting viscosity of 0.1 to 5 dl/g as measured in a decalin solution at 135° C. and which is prepared by a multistage polymerization method.

11. The method of producing a loudspeaker diaphragm as set forth in claim 8, wherein the wholly aromatic polyamide fibers are Kevlar.

12. The method of producing a loudspeaker diaphragm as set forth in claim 11, further comprising:

coating the wholly aromatic polyamide fibers with a urethane-based binding agent in an amount of 1 to 5% by weight based on the Kevlar.

13. The method of producing a loudspeaker diaphragm as set forth in claim 8, wherein the wholly aromatic polyamide fibers are cut to a length of 0.5 to 5 mm.

* * * * *